United States Patent [19]

Volpe

[11] 4,228,994

[45] Oct. 21, 1980

[54] VARIABLE JOGGER FOR A SHEET FEEDER

[75] Inventor: Richard L. Volpe, Hopedale, Mass.

[73] Assignee: White Consolidated Industries, Inc., Cleveland, Ohio

[21] Appl. No.: 58,093

[22] Filed: Jul. 16, 1979

[51] Int. Cl.[3] ..... B65H 9/10

[52] U.S. Cl. ..... 271/250; 271/254

[58] Field of Search ..... 271/221, 222, 238, 240, 271/248, 250, 253–255

[56] References Cited

U.S. PATENT DOCUMENTS

| | | | |
|---|---|---|---|
| 1,082,613 | 12/1913 | Spiess | 271/222 |
| 2,729,136 | 1/1956 | Feick et al. | 271/248 X |
| 2,732,206 | 1/1956 | Dietrich | 271/221 |
| 3,025,055 | 3/1962 | Bryant . | |
| 3,311,371 | 3/1967 | Zeuthen . | |
| 3,361,426 | 1/1968 | Pawlikowski et al. | 271/250 X |

FOREIGN PATENT DOCUMENTS

| | | | |
|---|---|---|---|
| 191823 | 1/1923 | United Kingdom | 271/221 |

*Primary Examiner*—Robert W. Saifer

*Attorney, Agent, or Firm*—Pearne, Gordon, Sessions, McCoy & Granger

[57] ABSTRACT

A pair of colinearly movable, reciprocating paddles for bumping the side edges of sheets flowing serially along a feed path is disclosed. The sheets travel between the reciprocating paddles in a direction generally perpendicular to paddle movement. The paddles jog the sheets into a correct alignment position to establish registry between the sheets and, for example, the plate cylinder of an offset printing press supplied with the sheets. The distance between each paddle and the sheet feed path centerline can be adjusted during reciprocating movement of the paddle to meet registry requirements. A disengagement mechanism permits separate use of either paddle.

10 Claims, 6 Drawing Figures

42
42a
42b
43
43a
43b
48
49
45
46
47
44
40
41
72
73
74
70
28
38
37
35
35a
35b
31
14
23
22
20
21
26
25
30
10
30b
30a
36
32
12
33
62
63
27
60
61
65
56
55
50
54
64
51
52
68
57
53

VARIABLE JOGGER FOR A SHEET FEEDER

BACKGROUND OF THE INVENTION

The present invention relates to mechanisms for the sequential feeding of sheet material, and more particularly to a paddle-type sheet jogger for the paper feed mechanism of an offset printing press, the jogger bumping paper sheets into alignment relative to the plate cylinder of the press as the sheets flow serially along a feed path towards the interface of the plate cylinder and the impression cylinder.

In the sequential feeding of paper sheet material to an offset press, it is imperative that proper alignment of the sheets relative to the plate cylinder of the press be established. It is known to align such sheets by jogging or bumping a side edge of each of the moving sheets with a paddle reciprocating along a line perpendicular to the path of movement of the serially flowing sheets.

Ideally, a jogger mechanism of the reciprocating paddle-type should be operable to jog or bump sheets into alignment from both sides of the paper feed path to faciliate the simultaneous feeding of two side-by-side sheets to the press, wherein, for example, a left side paddle would bump a left side sheet, while a right side paddle would simultaneously bump a right side sheet. Further, the ideal sheet jogger mechanism should permit individual adjustment of the distances between the paper feed path centerline and the left and right jogger paddles while the paddles are reciprocating, thus permitting print registry adjustments when the offset press is in a running condition.

SUMMARY OF THE INVENTION

The present invention provides a variable sheet jogger mechanism including a pair of carriage support bars extending across a sheet feeding path lying between the ends of the pair of bars, each bar being rotatable on its longitudinal axis. Each bar carries a carriage member which moves back and forth along its bar in response to bidirectional rotation of its bar. A drive means engages one end of the pair of bars to effect reciprocating movement of the bars back and forth along their longitudinal axes over a predetermined range of movement. A paddle positioning means engages the other end of the pair of bars, the positioning means rotating the bars on their longitudinal axes to effect movement of the carriage members back and forth along the bars while the bars are reciprocating.

In a preferred form, the mechanism of the present invention also includes means for separately disengaging either of the bars from the drive means to preclude their reciprocating movement. The present invention advantageously provides a relatively simple and reliable jogger mechanism that is easily adjustable to accommodate different size sheets and different sheet feeding modes, such as a single sheet feed mode and a dual side-by-side sheet feed mode.

DETAILED DESCRIPTION OF THE PREFERRED EMBODIMENT

Figures 1, 2, 3:
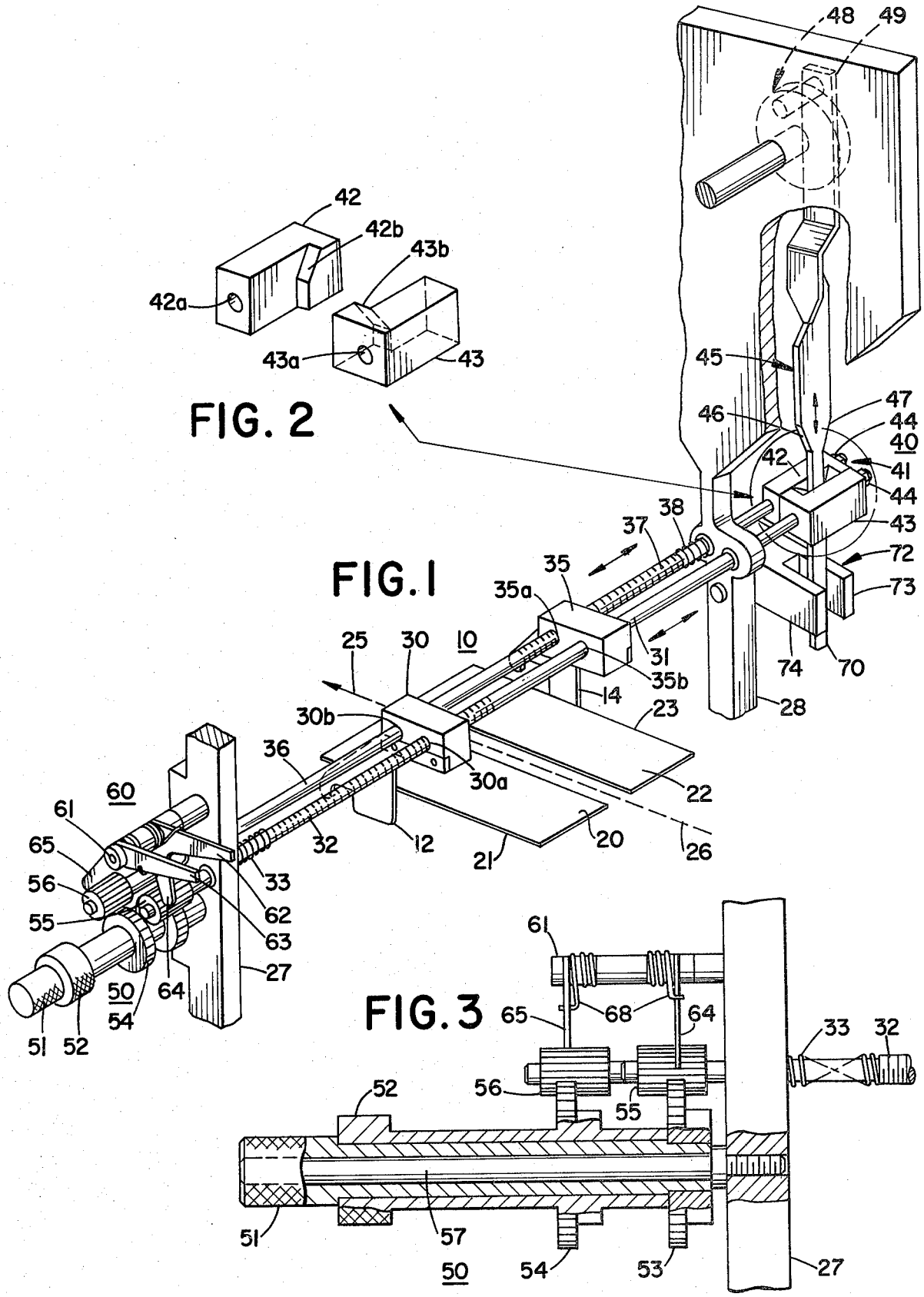
FIG. 1 illustrates, in perspective view, a jogger mechanism in accordance with the present invention, operable to simultaneously jog a pair of side-by-side sheets flowing along a feed path.
FIG. 2 illustrates, in perspective view, a pair of cam followers used as part of a reciprocating drive means illustrated in FIG. 1.
FIG. 3 is a partial cross sectional view of a paddle positioning adjustment means and a paddle disengagement means illustrated in FIG. 1.

Turning to the drawings, and in particular to FIG. 1, a variable sheet jogger mechanism 10 in accordance with the present invention is illustrated. The jogger mechanism 10 perpendicularly brackets or straddles a generally linear paper feed path extending to the sides of a feed path centerline 26, along which, for example, is transported a pair of juxtaposed paper sheets 20, 22. The sheets 20, 22 can be conveyed serially as pairs along the centerline 26 by means of conventional conveyor-type belt or chain mechanisms, for example, of the type utilized as a sheet feeder mechanism for an offset printing press. In such an offset printing press, the sheets 20, 22 move, as indicated by arrow 25, towards a plate cylinder (not illustrated) carrying ink images for transfer to the sheets. It is noted, and it will be subsequently illustrated, that either a pair of juxtaposed sheets 20, 22 or a single sheet can be fed for positioning by the jogger mechanism 10.

In traveling along the feed path centerline 26, the sheets 20, 22 are positioned in proper alignment for registry with side-by-side ink images on the plate cylinder of the press by the movements of a left-side jogger paddle 12 and a right-side jogger paddle 14. The left-side paddle 12 bumps the outer side edge 21 of the left sheet 20, while the right-side jogger paddle 14 bumps the outer side edge 23 of the right sheet 22. The bumping action of the paddles 12, 14 against the side edges of the sheets 20, 22 as they move between the paddles 12, 14 is provided by reciprocally driving the paddles to and away from the centerline 26, the paddles 12, 14 being colinearly movable along an axis perpendicular to the feed path centerline 26.

The left-side jogger paddle 12 is fixed to a left-side paddle support carriage 30, while the right-side jogger paddle 14 is similarly fixed to a right-side paddle support carriage 35. The carriage 30 includes a threaded bore **30*a* and a nonthreaded, smooth bore 30*b*, the bores being of approximately identical dimensions and extending parallel to each other transversely through the carriage 30. Likewise, the carriage 35 includes a threaded bore 35*a* and a nonthreaded, smooth bore 35*b* of similar orientation as the bores 30*a*, 30*b* of the left-side carriage. The carriages 30, 35 are supported by a pair of longitudinally extending, parallel bars or rods 31, 36. The left-side carriage support bar 31 includes a left-side threaded portion 32, while the right-side carriage support bar 36 includes a right-side threaded portion 37. In viewing FIG. 1 from left to right, the right-side carriage support bar 36 extends through the smooth bore 30*b* of the left-side paddle support carriage 30, while the right-side threaded portion 37 of bar 36 extends through the threaded bore 35*a* of the right-side paddle support carriage 35. In viewing FIG. 1 from right to left, the left-side carriage support bar 31 extends through the smooth bore 35*b*** of the right-side paddle support carriage 35, while the left-side threaded portion 32 of bar 31 extends through the threaded bore 30*a* of the left-side paddle support carriage 30. The ends of the pairs of bars 31, 36 are received in linear movement permitting bushings provided by frame members 27, 28, which permit both rotational movement and a predetermined degree of axial movement of the bars 31, 36. It can be seen that bidirectional rotation of the bar 36 effects translational movement of the right-side paddle support carriage 35 back and forth along the threaded portion 37 of the rod 36, while bidirectional rotation of the left-side carriage support bar 31 will effect back and forth translational movement of the left-side paddle support carriage 30. It may also be seen that the carriages 30, 35 are relatively rotationally fixed by slidable engagement of their respective smooth bores 30*b*, 35*b* with carriage bars 31, 36, respectively.

To effect reciprocating movement of the paddles 12, 14, away from and toward the centerline 26, the bars 31, 36 are moved back and forth along their longitudinal axes over a predetermined range. The left-side carriage support bar 31 is biased at one end travel position by a left-side return bias spring 33, while the right-side carriage support bar 36 is biased at one end travel position by a right-side return bias spring 38. As the left-side carriage support bar 31 is moved to the left, its return bias spring 33 is compressed. Likewise, as the right-side carriage support bar 38 is moved to the right, its return bias spring 38 is compressed. When the driving forces effecting axial movement of the bars 31, 36 are removed, the springs 33, 38 force the bars back to their normal at-rest position, illustrated in FIG. 1, wherein the paddles 12, 14 move toward each other to bump the side edges 21, 23 of the moving sheets 20, 22 and effect proper alignment of the sheet to establish registry between the sheets and the plate cylinder of the offset press.

It can be seen that rotation of the bars 31, 36 during their reciprocating movement will adjustably position the extent of travel of the paddles 12, 14 wherein the distances between the centerline 26 and the paddles 12, 14 can be varied to meet the requirements of sheet size and registry needs.

As illustrated in FIG. 1, at the right end of the pair of bars 31, 36 a drive means 40 is provided for reciprocating the bars, while a paddle positioning means 50 for rotating the bars 31, 36 and a disengagement mechanism 60 deactivating either of the bars are provided at the other end of the pair of bars 31, 36.

The drive means 40 includes a cam follower means 41 which engages a cam member 45 having its upper end 49 driven in reciprocal fashion by an eccentric drive mechanism 48 or other drive mechanism of a suitable type for effecting reciprocating up-and-down movement of cam member 45 in a direction generally perpendicular to the longitudinal axes of the bars 31, 36. The other end 70 of the cam member 45 is received by a cam guide 72 fixed to the right-side frame member 28, the cam guide receiving the guided end 70 of the cam member 45 in a U-shaped aperture defined by a pair of parallel extending leg portions 73, 74 of the guide 72. The cam member 45 includes a left paddle cam surface 46 and an opposed right paddle cam surface 47.

With reference to FIG. 2, the cam follower 41 includes a right paddle cam follower 42 and a left paddle cam follower 43. The right cam follower 42 includes a bore 42*a* extending transversely therethrough for receiving the right-hand end of the bar 36, while the left cam follower 43 likewise contains a bore 43*a* for receiving the right-hand end of bar 31. The cam followers 42, 43 are axially fixed on the ends of the bars 31, 36 by appropriate cam follower fasteners such as retaining nuts 44. However, the nuts 44 do not rotationally lock the cam followers 42, 43 relative to the bars 31, 36, but, rather, permit rotation of the bars without rotation of the cam followers, 42, 43.

With reference to FIGS. 1 and 2, upon downward movement of the cam member 45 from the position illustrated in FIG. 1, the left paddle cam surface 46, and the right paddle cam surface 47 simultaneously engage cam follower surfaces 43*b*, 42*b* to effect movement of the cam followers 42, 43 away from each other. As the cam followers 42, 43 move away from each other, the respective biasing springs 33, 38 are compressed and the paddles 12, 14 move away from the paper path centerline 26. As the cam member 45 is raised, the cam surfaces 46, 47 disengage from the cam follower surfaces 42*b*, 43*b* and the bias springs 33, 38 force the paddles 12, 14 back toward the paper path centerline 26 to effectively bump the side edges of nonaligned paper sheets to position them as they move between the paddles in the direction illustrated by FIG. 5.

To effectively adjust the position of the reciprocating carriages 30, 35 relative to the paper path centerline 26, a paddle positioning means 50 is provided. The positioning means 50 includes a left paddle adjustment knob 51 for rotating a left paddle driving spur gear 53 and a right paddle adjustment knob 52 for driving a right paddle driving spur gear 54. The driving spur gears 53, 54 are fixed relative to a common longitudinal axis of rotation parallel to and spaced from the axes of the bars 31, 36. The driving spur gears 53, 54 engage respective driven spur gears 55, 56 rotationally and axially fixed to the end of the pair of reciprocating bars, as illustrated in FIG. 1. The longitudinal extent of the toothed surfaces of the driving spur gears 53, 54 and the driven spur gears 55, 56 are parallel to the longitudinal axes of the reciprocating rods so as to permit sliding movement of the driven spur gears 55, 56 back and forth relative to the engaged driving spur gears 53, 55. The gear pairs 54, 56 and 53, 55 constitute external contact spur gears. Rotation of the left paddle adjustment knob 51 causes rotation of the driving spur gear 53, which in turn rotates the reciprocating driven spur gear 55 to respectively rotate the rod 31 and its threaded portion 32, which engages the left paddle carriage 30, which linearly moves along back and forth on the rod 31 according to the direction of rotation of adjustment knob 51. Likewise, rotation of the right paddle adjustment knobs 52 causes rotation of driving spur gear 54, which in turn rotates the reciprocating driven spur gear 56 to effect movement of the carriage 35 along the threaded portion 37 of carriage bar 36. It can be seen that the paddle positioning means 50 effectively permits independent movement of either carriage 30, 35 toward and away from the paper feed path centerline 26.

FIG. 1 illustrates the use of the present invention wherein two sheets of paper are simultaneously fed side by side toward, for example, the plate cylinder of the offset printing press. In such an application, it is desirable to utilize both the left-side jogger paddle 12 and the right-side jogger paddle 14 simultaneously, as illustrated and discussed above. If only a single sheet is being fed, only one side jogger paddle need be utilized. A disengagement mechanism 60 is provided which includes a disengagement mechanism spindle 61 upon which are rotationally mounted for pivotal movement a left paddle release handle 62 and a right paddle release handle 63. The left paddle release handle extends from its pivoted end (at spindle 61) in bell crank fashion to provide a left paddle retainer finger 64 which is spring-biased against and rides upon the reciprocating toothed surface of driven spur gear 55. Likewise, the right paddle release handle 63 extends in bell crank fashion from its pivoted end (at spindle 61) to provide a right paddle retainer finger 65 which is spring-biased against and rides upon the toothed surface of the driven spur gear 56.

The structure of the paddle positioning means 50 and the disengagement mechanism 60 is more apparent with reference to FIG. 3, wherein it may be seen that the left paddle and right paddle retainer fingers 64, 65 are spring-biased by appropriate biasing springs 68 in opposed, clockwise direction relative to the spindle 61 when both paddles 12, 14 are jogging wherein the driven spur gears 55, 56 are sliding back and forth relative to and in engagement with the driving spur gears 53, 54. A paddle adjustment spindle 57 is fixed to the frame member 27 and extends generally perpendicularly therefrom to provide a common axis of rotation for the left paddle adjustment knob 51, which rotates on the spindle 57 and is terminated at its inward end by the left paddle driving spur gear 53. The left paddle adjustment knob 52 is coaxially mounted relative to the spindle 57 and the left paddle adjustment knob 51 to rotate the right paddle driving spur gear 54 located at the inward end of the left paddle adjustment knob 52. It may be seen that independent rotation of the knobs 52, 54 is provided to separately rotate the driving spur gears 53, 55 for effective independent rotation of either of the carriage support bars 31, 36 to effect adjustment of the carriage positions, as discussed earlier.

The function of the disengagement mechanism 60 will now be discussed in greater detail with reference to FIGS. 4, 5, and 6.

Figure 4:
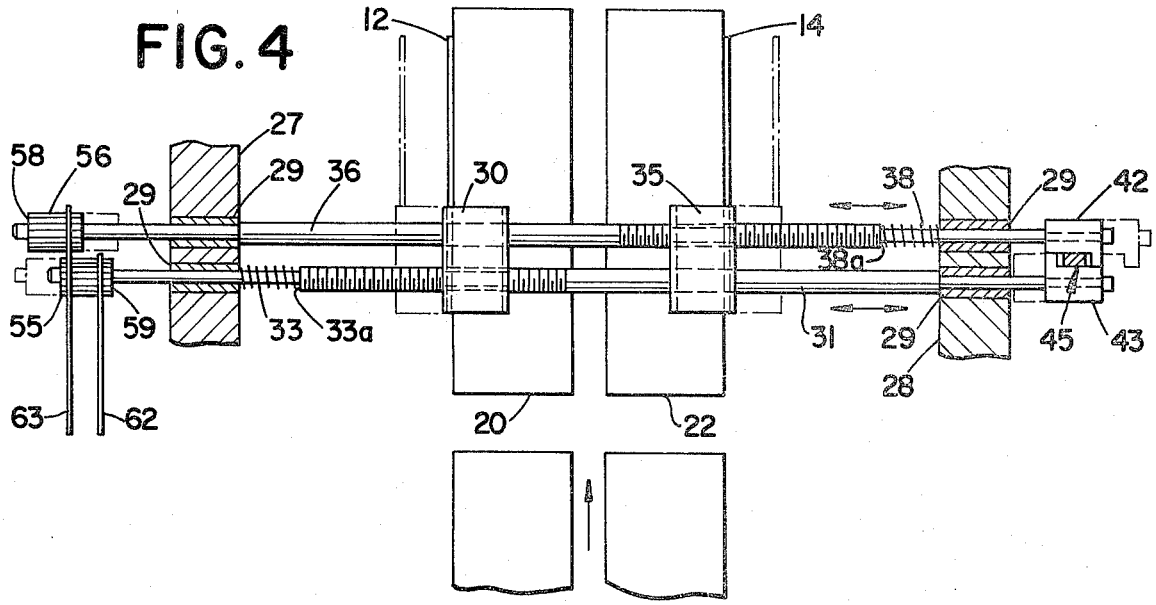
FIG. 4 is a plan, partial cross section view of a portion of the jogger mechanism of FIG. 1, with both paddles engaged for reciprocating, jogging motion.

In FIG. 4, the jogger mechanism is illustrated with the disengagement mechanism in a position to permit both paddles 12 and 14 to jog a left sheet 20 and a right sheet 22, respectively, with downward movement of the cam member 45, as discussed earlier. Cam follower 43 moves to the left, as viewed in FIG. 4, and cam follower 42 moves to the right. Bias spring 33 is compressed between one of four linear movement bushings 29 and a radially extending shoulder **33*a* provided by carriage support bar 31, while bias spring 38 is likewise compressed between another one of the linear motion bushings 29 and a radially extending shoulder 38*a* provided by the carriage support bar 36. With the left paddle release handle and the right paddle release handle 62, 63 in their normal positions, as illustrated in FIG. 1**, the bars are free to reciprocate.

Figure 5:
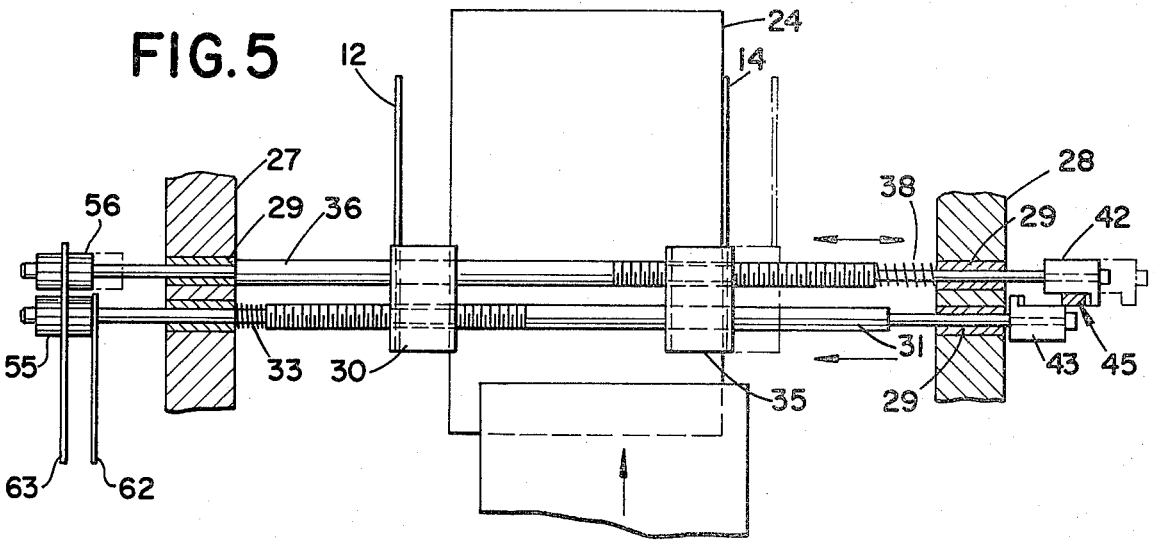
FIG. 5 is a plan view as in FIG. 4, with the left side jogger paddle locked at a disengaged position.

Turning to FIG. 5, the jogger mechanism of the present invention is illustrated in a configuration for right-side paddle jogging only for single-sheet jogging. The left-side jogger paddle 12 is locked away from a single sheet 24 wherein the mechanism operator manually moves the support bar 31 to a far-left position so as to fully compress bias spring 33 and allow the spring-biased right side paddle release handle 63 to snap to a lower position wherein the left paddle retainer 64 (See FIG. 1) snaps in front of the inside end face 59 (See FIG. 4) of spur gear 55. When the operator releases the bar 31, it is held in a disengaged position, as illustrated in FIG. 5, by the left paddle retainer 64. Since the cam follower 43 is pulled away from engagement with the cam member 45, and in particular the cam surface 46, the bar 31 does not reciprocate, that is, it does not jog. To re-engage the carriage support bar 31 for reciprocating motion, a left paddle release handle 62 is raised so as to lift the left paddle retainer up away from the carriage support bars 31, thus allowing the bias spring 33 to snap the bar 31 and its cam follower 43 back to an engagement position with the cam member 45.

Figure 6:
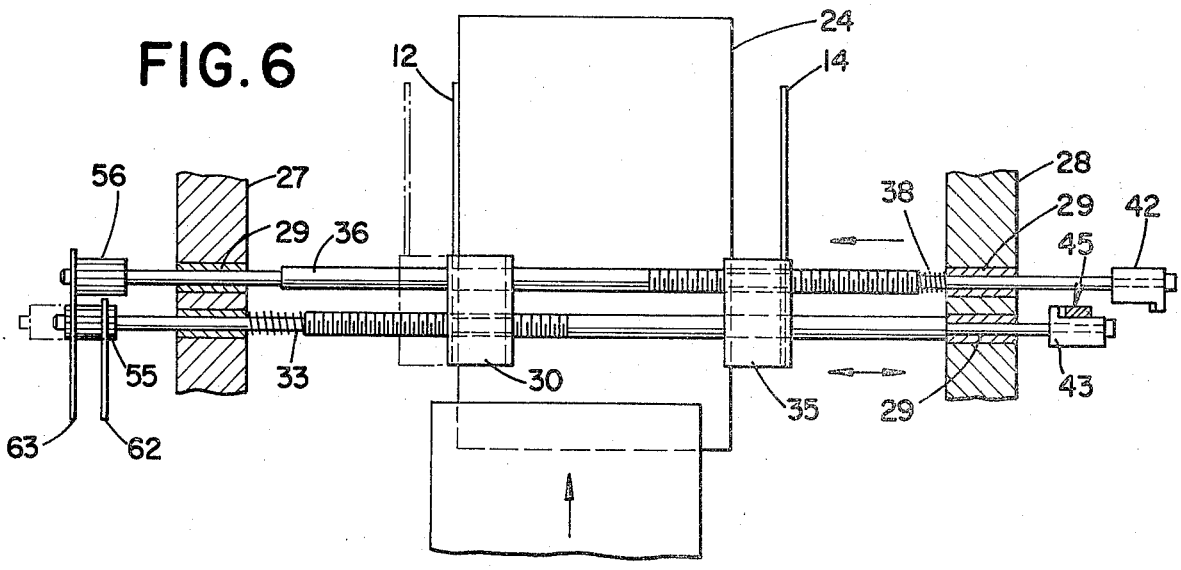
FIG. 6 is a plan view as in FIG. 4, with the right side jogger paddle locked at a disengaged position.

FIG. 6 illustrates the positioning of the right-side jogger paddle 14 in a disengaged position relative to the cam member 45, wherein the mechanism operator manually moves the carriage support bar 36 to a far-right position to fully compress bias spring 38 and allow the spring-biased right paddle retainer finger 65 (See FIG. 1) to snap down in back of the right paddle driven spur gear 56 and engage its outside or rearward face 58 (See FIG. 4). In a similar manner as discussed with regard to FIG. 5, the carriage support bar 36 and its cam follower 42 are held by the retainer finger 65 in a disengaged position relative to the cam member 45. To release the carriage support bar 36 for re-engagement with the cam member 45, the operator merely presses down on the right paddle release handle, thus lifting the right paddle retainer 65 away from the carriage support bar 36 to allow the spring 38 to snap the bar 36 back to its normal engaged position with the cam follower 45.

It can be seen that the illustrated jogger mechanism of the present invention provides a simple and reliable means for jogging the left or right side of sheets flowing serially along a paper feed path, the positioning of the paddles relative to the paper path centerline being adjustable during operation of the mechanism.

Although a preferred embodiment of this invention has been shown and described, it should be understood that various modifications and rearrangements of parts may be resorted to without departing from the scope of the invention as defined in the claims.

What is claimed is:

1. A sheet jogger mechanism comprising:

a pair of carriage support bars extending across a sheet feeding path lying between the ends of the pair of bars, each bar being rotatable on its longitudinal axis;

a pair of paddle providing carriage members each carried on a respective one of the pair of bars, bidirectional rotation of the bars effecting movement of the carriage members back and forth along the bars;

drive means engaging one end of the pair of bars to effect reciprocating movement of the bars back and forth along their longitudinal axes over a predetermined range of movement; and paddle positioning means engaging the other end of the pair of bars for rotating the bars to effect carriage movement along the bars while the bars are reciprocating back and forth along their longitudinal axes.

2. A sheet jogger mechanism according to claim 1, including means for separately disengaging each of the bars from the drive means to effect reciprocating movement of only one of the bars.

3. A sheet jogger mechanism comprising:

a pair of carriage support bars extending generally parallel to each other along axes generally perpendicular to a sheet feeding path lying between the ends of the pair of bars, each bar being mounted for bidirectional rotation on and axial movement along a longitudinal axis, each rod having a threaded length portion;

a pair of generally rotationally fixed carriage members, each carriage member threadingly engaging a respective one of the threaded length portions of the carriage support bars, rotation of each bar effecting movement of its respective carriage along its threaded length portion;

cam follower means mounted at and engaging one end of the pair of bars;

a movable cam member having cam surfaces for engaging the cam follower means, movement of the cam member effecting movement of the cam follower means, movement of the cam follower means effecting reciprocating linear movement of the rods back and forth along their longitudinal axes over a predetermined range of movement; and paddle position adjustment means located at the other end of the pair of rods for rotating the carriage support rods during their reciprocating movement to effect linear movement of the carriages along the threaded length portions of their respective reciprocating support rods.

4. A sheet jogger mechanism according to claim 3, wherein the cam member reciprocates back and forth along an axis generally perpendicular to the longitudinal axes of the reciprocating carriage support bars, the cam surfaces carried by the cam member moving into and out of engagement with the cam follower means to effect the reciprocating movement of the carriage support rods back and forth along their longitudinal axes.

5. A sheet jogger mechanism according to claim 4, including spring biasing means for maintaining the carriage support rods at a predetermined axial position when the cam surfaces of the cam surface member are disengaged from the cam follower means.

6. A sheet jogger mechanism according to claim 4, wherein the cam surfaces include a pair of cam surfaces in opposed relation to effect opposite direction movement of the respective pair of carriage support rods when the pair of cam surfaces engages the cam follower means.

7. A sheet jogger mechanism according to claim 6, wherein the cam follower means includes a pair of cam followers, one of the cam followers being axially fixed to the end of one of the pair of rods, the other cam follower being axially fixed to the other of the pairs of rods, each cam follower being engageable with a respective one of the pair of opposed cam surfaces.

8. A sheet jogger mechanism according to claim 7, wherein the opposed cam surfaces simultaneously engage and disengage from the cam follower means to simultaneously move the carriage support rods.

9. A sheet jogger mechanism according to claim 3, wherein the paddle position adjustment means includes a pair of adjustment knobs rotational on a common axis spaced from and parallel to the longitudinal axes of the bars, each knob driving a gear member each engageable with the end portion of a respective one of the support bars, the gear members maintaining engagement with the bar ends over the predetermined range of axial movement of the bars along their longitudinal axes.

10. A sheet jogger mechanism according to claim 9, wherein each carriage support bar provides a gear member, the gear member of each bar and the gear member of its respective adjustment knob constituting a pair of engaged external contact spur gears translationally movable relative to each other along axes parallel to the longitudinal axes of the support bars.

* * * * *